US006419345B1

(12) United States Patent
Kagayama

(10) Patent No.: US 6,419,345 B1
(45) Date of Patent: Jul. 16, 2002

(54) IMAGE-FORMING APPARATUS WITH ELECTRIC-FIELD CONTROL OF DATA AND SELECTION ELECTRODES

(75) Inventor: Shigeru Kagayama, Owariasahi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 08/321,324

(22) Filed: Oct. 11, 1994

(30) Foreign Application Priority Data

Nov. 12, 1993 (JP) ..... 5-283040

(51) Int. Cl.[7] ..... B41J 2/06
(52) U.S. Cl. ..... 347/55
(58) Field of Search ..... 347/55, 12, 13, 347/57, 112, 141, 151, 142, 144, 145, 120, 128, 237; 355/261, 262

(56) References Cited

U.S. PATENT DOCUMENTS

| | | | | | |
|---|---|---|---|---|---|
| 3,689,935 | A | | 9/1972 | Pressman et al. | 347/55 |
| 4,448,867 | A | * | 5/1984 | Ohkubo et al. | 430/31 |
| 4,641,156 | A | * | 2/1987 | Ohta et al. | 347/224 |
| 4,743,926 | A | | 5/1988 | Schmidlin et al. | 347/55 |
| 4,755,837 | A | | 7/1988 | Schmidlin et al. | 347/55 |
| 4,780,733 | A | | 10/1988 | Schmidlin | 347/55 |
| 4,807,047 | A | * | 2/1989 | Sato et al. | 347/112 X |
| 4,814,796 | A | | 3/1989 | Schmidlin | 347/55 |
| 4,912,489 | A | | 3/1990 | Schmidlin | 347/55 |
| 5,036,341 | A | | 7/1991 | Larason | 347/55 |
| 5,404,155 | A | * | 4/1995 | Kitamura | 347/55 |
| 5,414,500 | A | * | 5/1995 | Furukawa | 347/55 |
| 5,448,272 | A | * | 9/1995 | Kagayama | 347/55 |

FOREIGN PATENT DOCUMENTS

| | | | | |
|---|---|---|---|---|
| JP | 59214053 | | 12/1984 | 347/55 |
| JP | 61169853 | | 7/1986 | 347/55 |
| JP | 1-210360 | * | 8/1989 | |
| JP | 584963 | * | 4/1993 | 347/55 |
| JP | 0624029 | * | 2/1994 | |
| JP | 0664217 | * | 3/1994 | |

* cited by examiner

*Primary Examiner*—Benjamin R. Fuller
*Assistant Examiner*—C Dickens
(74) *Attorney, Agent, or Firm*—Oliff & Berridge, PLC

(57) ABSTRACT

A selection electrode is formed in correspondence with each aperture of an aperture electrode unit, and a data electrode is formed every two or four adjacent apertures on the same plane as the selection electrode. The selection electrodes and the data electrodes are time-divisionally driven by controlling voltages to be applied to these electrodes. Therefore, a high-resolution recording operation can be performed with a small number of driving ICs, and the cost can be reduced.

19 Claims, 7 Drawing Sheets

Fig.4

| | SELECTION ELECTRODE -100V | SELECTION ELECTRODE -30V |
|---|---|---|
| DATA ELECTRODE -30V | OFF | OFF |
| DATA ELECTRODE +30V | OFF | ON |

IMAGE-FORMING APPARATUS WITH ELECTRIC-FIELD CONTROL OF DATA AND SELECTION ELECTRODES

BACKGROUND OF THE INVENTION

1. Field of the Invention

The present invention relates to an image forming apparatus that is suitably usable for a copying machine, a printer, a plotter, a facsimile machine, or the like.

2. Description of Related Art

One image forming apparatus that has been conventionally known is disclosed in U.S. Pat. No. 3,689,935 in which an electrode having plural opening portions (hereinafter referred to as "apertures") is used, and a voltage is applied to the electrode in accordance with image data to control passage of toner particles through the apertures, whereby an image is formed on a supporter (image receiving medium) with toner particles that have past through the apertures.

The image forming apparatus includes an aperture electrode unit comprising an insulating flat plate, a reference electrode formed continuously on one surface of the flat plate, plural control electrodes that are formed on the other surface of the flat plate and that are electrically insulated from one another, and at least one row of apertures each of which is formed in correspondence with each control electrode so as to penetrate through the flat plate, the reference electrode and the control electrodes. The image forming apparatus also includes structure for selectively applying a voltage across the reference electrode and the control electrodes, structure for supplying charged toner particles so that the flow of the toner particles passed through the apertures is modulated in accordance with the applied voltage, and structure for moving a supporter and the aperture electrode unit relative to each other to position the supporter in a particle flow passage.

U.S. Pat. Nos. 4,743,926, 4,755,837, 4,780,733, and 4,814,796 disclose image forming devices having an aperture electrode unit disposed so that control electrodes face a supporter and a reference electrode faces a toner supply side.

On the other hand, U.S. Pat. No. 4,912,489 discloses an aperture electrode unit disposed so that the reference electrode faces the supporter and the control electrodes face the toner supply side. The reference describes that a voltage to be applied to the control electrodes at an off-time can be reduced to about a quarter of that of the image forming apparatus as disclosed in the above patents.

The term "off-time" means a time when no toner particle is attached onto the supporter, that is, when a blank portion of an image is formed on the supporter, and conversely, the term "on-time" means a time when a toner image is formed on the supporter.

However, in the conventional image forming apparatus as described above, each aperture is controlled in accordance with a voltage to be applied to each control electrode, and thus, there is a problem that the cost of the driving circuit is high. For example, an A4-size aperture electrode unit having 200 DPI resolution is provided with 1728 apertures, and thus, driving circuits whose number is equal to the number of the apertures are required to drive all the apertures independently of one another. Particularly, a driving circuit using a driving voltage exceeding 40 volts is very expensive, and it is therefore impractical to use a number of these expensive circuits. Further, a higher resolution of about 600 DPI is becoming more popular in the market, and in order to realize the high 600 DPI resolution, an even larger number of apertures must be provided in the aperture electrode unit. Therefore, the problem is worsening.

SUMMARY OF THE INVENTION

An object of the present invention is to provide an image forming apparatus that is capable of performing a recording or printing operation at a high resolution with a small number of driving ICs and that is low in cost.

In order to attain the above object, the image forming apparatus according to the present invention includes a carrier for carrying charged particles, an electric-field controller that is disposed so as to face the carrier and for directly controlling the charged particles with an electric field, and a back electrode that is disposed so as to face the carrier through the electric-field controller. The electric-field controller has openings through which the charged particles pass. The apparatus also includes a plurality of electrode units that are disposed adjacent the openings, the plurality of electrode units being time-divisionally driven.

In the image forming apparatus of the present invention thus constructed, the plurality of electrodes are time-divisionally driven, and an electric-field control operation is effectively performed. Accordingly, for example, if data electrodes and selection electrodes are used, an image recording operation can be properly performed because both of the electrodes can provide sufficient toner flying (supplying) force to the toner, and in addition, the number of driving ICs can be reduced, resulting in a reduction of cost.

In a preferred embodiment, the data electrode is adjacent at least two of the plurality of openings, and the selection electrode is adjacent at least one of the plurality of openings. The data electrode controls the charged particles passing through the at least two of the plurality of openings.

BRIEF DESCRIPTION OF THE DRAWINGS

Preferred embodiments of the present invention will be described in detail with reference to the following figures wherein:

FIG. 4 is a table showing a voltage applying condition of a selection data electrode and a data electrode;

DETAILED DESCRIPTION OF PREFERRED EMBODIMENTS

Preferred embodiments according to this invention will be described with reference to the accompanying drawings.

Figure 1:
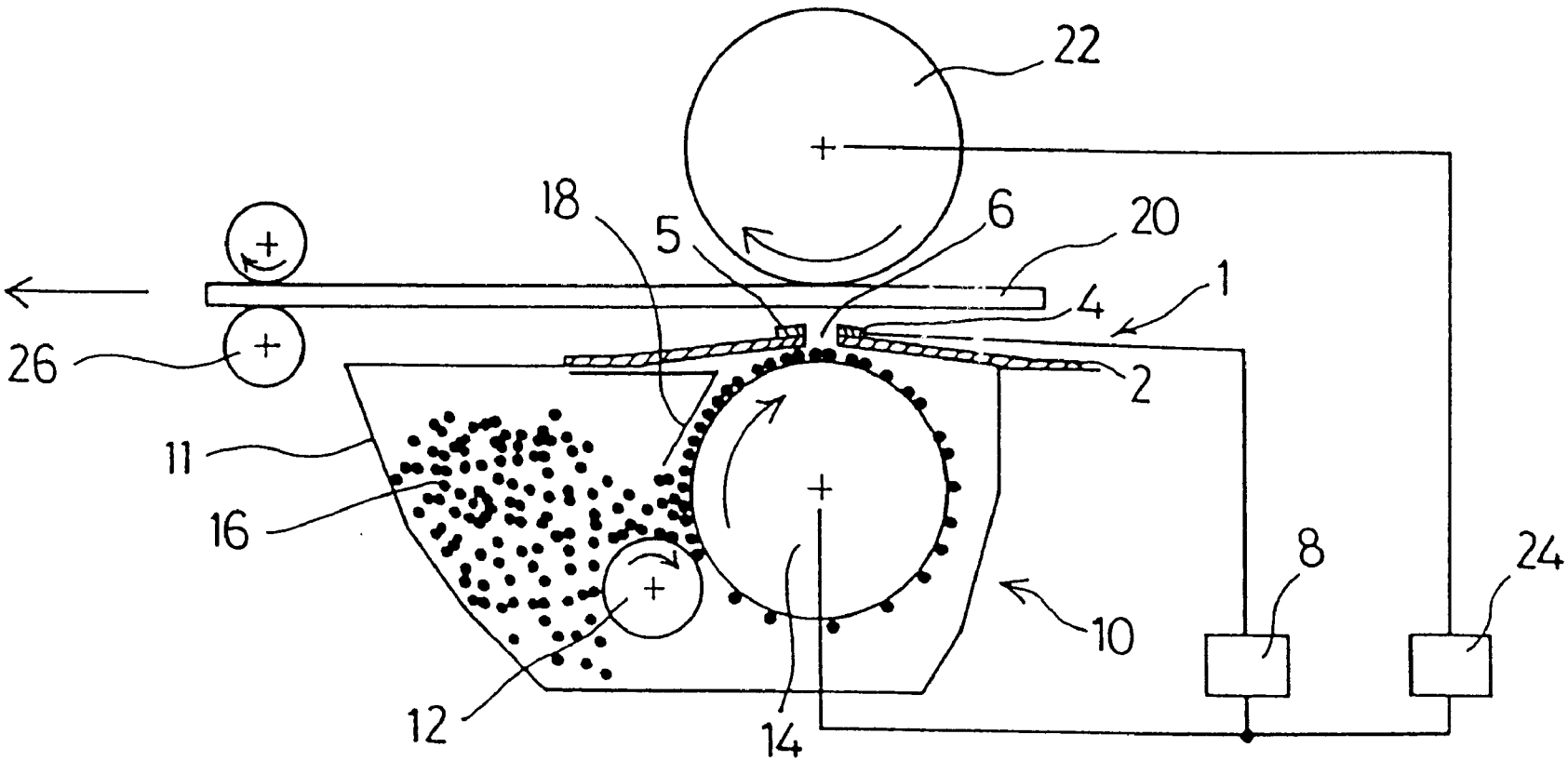
FIG. 1 is a diagram showing the construction of an image forming apparatus according to the invention.
Figure 2:
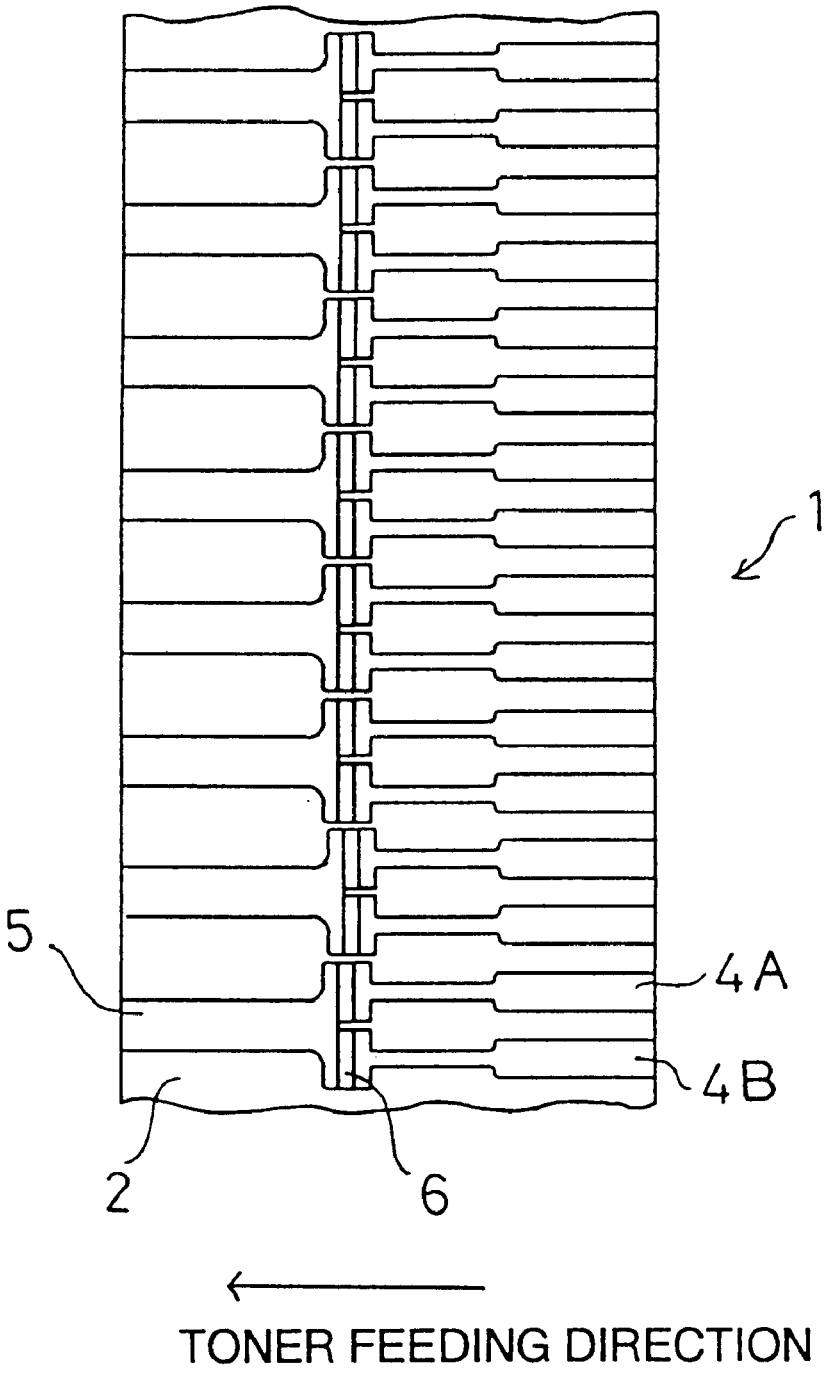
FIG. 2 is a plan view showing the construction of an aperture electrode unit used in the image forming apparatus.

FIG. 1 schematically shows an image forming apparatus according to the invention. In the image forming apparatus shown in FIG. 1, a cylindrical back electrode roller 22 is rotatably supported by a chassis (not shown) so as to be spaced at about 1 mm from and above the upper side of an aperture electrode unit 1, whereby an image receiving medium 20 can be inserted and fed into the gap between the back electrode roller 22 and the aperture electrode unit 1. In addition, a toner supply device 10 is disposed at the lower side of the aperture electrode unit 1 along a longitudinal direction of the aperture electrode unit 1, and a fixing device 26 is disposed downstream of a feeding path of the image receiving medium 20, which is fed by the back electrode roller 22.

Next, each of the above elements will be individually described in more detail.

The toner supply device 10 comprises a toner case 11, which also serves as a housing for the device itself, toner 16 stocked in the toner case 11, a toner supply roller 12, a toner carry roller 14, and a toner-layer restricting blade 18. The toner carry roller 14 serves to carry the toner 16 thereon and feed the toner 16 toward the aperture electrode unit 1, and the toner supply roller 12 serves to supply the toner 16 to the toner carry roller 14.

The toner supply roller 12 and the toner carry roller 14 are supported by the toner case 11 so as to be rotatable in a direction as indicated by the arrows in FIG. 1, and both of the rollers 12 and 14 are disposed in contact with and in parallel to each other. The toner-layer restricting blade 18 serves to adjust a toner layer so that the amount of the toner 16 carried on the toner carry roller 14 is made uniform on the roller surface, the toner 16 is uniformly charged, and it is in pressed contact with the toner carry roller 14.

The aperture electrode unit 1 comprises a polyimide insulating sheet 2 having a thickness of about 25 $\mu$m in which plural apertures 6 are formed in a row, and selection electrodes 4A and 4B and data electrodes 5 each of which is designed to have a thickness of about 1 $\mu$m. The electrodes 4A, 4B and 5 are formed on the upper surface of the insulating sheet 2 in correspondence with each of the apertures 6.

Describing in more detail, each aperture 6 is designed in a slit shape. The selection electrodes 4A and 4B are disposed at an upstream side of a toner feeding direction of the respective apertures, and each data electrode 5 is disposed at a downstream side of the toner feeding direction so as to be allocated to each pair of adjacent two apertures. As shown in FIG. 1, the aperture electrode unit 1 is pressed against the toner carry roller 14 at the aperture position on the insulating sheet 2 while the selection electrodes 4A and 4B face the image receiving medium 20.

Next, the positional relationship between the apertures 6 of the aperture electrode unit 1 and the toner carry roller 14 will be described in detail.

Figure 3A:
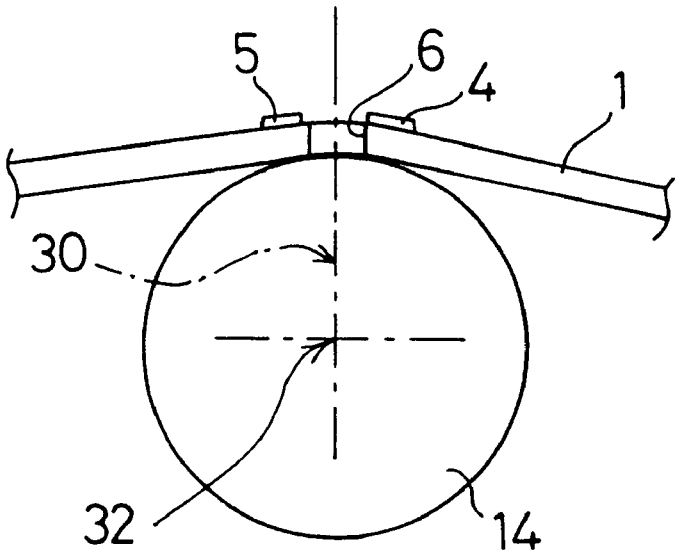
FIG. 3A is a diagram showing the construction of an aperture electrode unit and a toner carry roller used in the image forming apparatus.
Figure 3B:
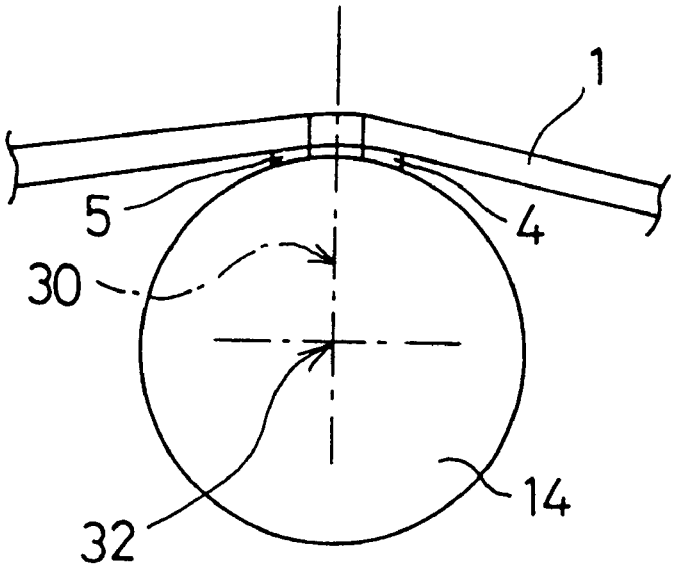
FIG. 3B is a diagram showing the construction of an aperture electrode unit and a toner carry roller used in the image forming apparatus.

As shown in FIGS. 3A and 3B, each aperture 6 is disposed so that the center line 30 thereof passes through the highest portion of the perimeter of the toner carry roller 14 and the center axis 32 of the toner carry roller 14. With this arrangement, each aperture 6 is uniformly disposed at the right and left sides with respect to the highest portion of the perimeter of the toner carry roller 14, so that the toner 16 passing through each aperture 6 can be uniformly distributed over the whole area in the aperture. In addition, since the wall surface of each aperture 6 is substantially parallel to a flight (supply) direction of the toner 16, the toner can be stably supplied through the apertures 6.

The aperture electrode unit 1 itself is pressed against the toner carry roller 14 so as to be flexible to the right and left sides with respect to the apertures 6 relative to the toner carry roller 14. With this arrangement, the contact area between the aperture electrode unit 1 and the toner carry roller 14 can be increased, and the lower peripheral portion of each aperture 6 can be uniformly pressed at the right and left sides thereof, so that unevenness of toner density can be minimized.

The data electrodes 5 and the selection electrodes 4 may be provided at the opposite side of the toner carry roller 14 as shown in FIG. 3A, or may be provided at the toner carry roller 14 side as shown in FIG. 3B.

A control voltage applying circuit 8 is connected across the toner carry roller 14 and each of the selection electrodes 4A and 4B and the data electrodes 5. The control voltage applying circuit 8 serves to apply a voltage of −30V or −100V to the selection electrodes 4A and 4B in accordance with an image signal, and apply a voltage of +30V or −30V to the data electrode 5. A DC power source 24 is connected across the back electrode roller 22 and the toner carry roller 14, and it serves to apply a voltage of +1 kV to the back electrode roller 22.

Next, the operation of the image forming apparatus thus constructed will be described.

First, through rotation of the toner carry roller 14 and the toner supply roller 12 as indicated by an arrow of FIG. 1, the toner 16 that is fed from the toner supply roller 12 is rubbed against the toner carry roller 14 to be negatively charged and carried on the toner carry roller 14. The carried toner 16 is thinned by the toner-layer restricting blade 18 to form a thin toner layer and fed toward the aperture electrode unit 1 by rotation of the toner carry roller 14. Thereafter, the toner on the toner carry roller 14 is supplied to the apertures 6 while being rubbed against the insulating sheet 2 of the aperture electrode unit 1.

Here, in accordance with the image signal, the selection electrodes 4A and 4B and the data electrodes 5 are supplied with voltages in a so-called time-divisional driving mode. That is, voltage combinations as shown in FIG. 4 are used for the selection electrodes and the data electrodes, and toner flow is generated only in a case of a specific combination, that is, when the selection electrodes are supplied with −30V and the data electrodes are supplied with +30V.

Voltage application is conducted on the selection electrodes 4A and 4B and the data electrodes 5 corresponding to an image portion by the control voltage applying circuit 8. That is, as shown in FIG. 4, −30V is applied to the selection electrodes while +30V is applied to the data electrodes. As a result, an electric line of force from the selection electrodes 4 to the toner carry roller 14 is generated in the vicinity of the apertures 6 corresponding to the image portion due to the potential difference between the data electrodes 5 and the selection electrodes 4 and the toner carry roller 14. With this electric line of force, the negatively charged toner is electrostatically attracted to a higher potential position and passes from the surface of the toner carry roller 14 through the apertures 6 to the data electrodes 5. The attracted toner 16 is further attracted toward the image receiving medium 20 due to an electric field that is generated between the image receiving medium 20 and the aperture electrode unit 1 by the voltage applied to the back electrode 22, and the toner is deposited on the image receiving medium 20, whereby an image is formed on the image receiving medium 20.

The selection electrodes 4 and the data electrodes 5 corresponding to a non-image portion are supplied with a voltage combination (−100V, −30V), (−100V, +30V) or (−30V, −30V) from the control voltage applying circuit 8. As a result, no electric field is generated between the toner carry roller 14 and the control electrodes 4, and the toner 16 on the toner carry roller 14 is not electrostatically attracted and does not pass through the apertures 6.

The respective data for two apertures are alternately supplied to each data electrode 5 through an on/off operation of an applied voltage, and at the same time, a selection voltage for selecting one of the two apertures to be switched on is applied to the selection electrodes 4A and 4B. That is, an on/off voltage is applied to the selection electrodes 4A and 4B in synchronism with the transmitted data, and in this case, a time-divisional driving of ½ duty can be performed. Therefore, the number of driving circuits used for the data electrodes can be reduced to a half, and the cost of the driving circuits can be greatly reduced. In addition, according to the electric-field forming system of this embodiment, the control operation is performed using a plan on which the electrodes are arranged, and thus, optimum control of the toner flight can be performed. Accordingly, occurrence of dispersion in a print characteristic between respective time-divisional blocks, which is one of the conventional problems, can be prevented, and an excellent and extremely uniform recording operation can be performed.

The image receiving medium 20 is fed in a direction perpendicular to the aperture array by one picture element while a line (row) of picture elements are formed on the image receiving medium 20 with the toner 16. By repeating the above process, a toner image is formed on the whole surface of the image receiving medium 20. Thereafter, the toner image thus formed is fixed onto the image receiving medium 20 by the fixing device 26.

If insulating toner is used in the image forming apparatus thus constructed, insulation between the toner carry roller 14 and the selection electrodes 4 is maintained, and no breakdown occurs in the apertures 6.

In the above process, the control electric field by the selection electrodes 4A and 4B and the data electrodes 5 is formed inside of each electrode and the apertures 6, and between the apertures 6 and the toner carry surface of the toner carry roller 14, which is facing the apertures 6, and thus, the control electric field can be directly applied to the carried toner 16, so that control efficiency can be improved.

Further, even when a part of the supplied toner 16 is subject to a mechanical force or the like through the sliding motion between the toner 16 and the aperture electrode unit 1 and it invades into the apertures 6 corresponding to the non-image portion, the toner can be controlled not to be passed through the apertures 6 by the electric field occurring in the apertures 6, so that high controllability of the toner is obtained.

The toner carry roller 14 and the aperture electrode unit 1 are disposed so as to face each other through the toner layer, and thus, these elements can be disposed a relatively short distance apart. Accordingly, the control voltage can be reduced, and inexpensive drive elements can be used.

Moreover, the insulating sheet 2 of the aperture electrode unit 1 is disposed so as to face the toner carry roller 14. Accordingly, even in a case where no toner 16 exists on the toner carry roller 14 because of failure of the toner supply system, contact between the selection electrodes 4 or the like and the toner carry roller 14, causing short-circuit of these elements can be prevented, and thus, the driving elements can be prevented from being broken down.

The aperture electrode unit 1 and the toner 16 on the toner carry roller 14 are contacted with each other at the inlet ports of the apertures, and thus, the toner that is deposited at the inlet ports of the apertures 6 is pushed out by the toner that is successively supplied from the toner carry roller 14, so that clogging of the apertures 6 due to deposition and bridging of the toner 16 does not occur.

This invention is not limited to the above embodiment, and various modifications may be made without departing from the scope of this invention.

Figure 3C:
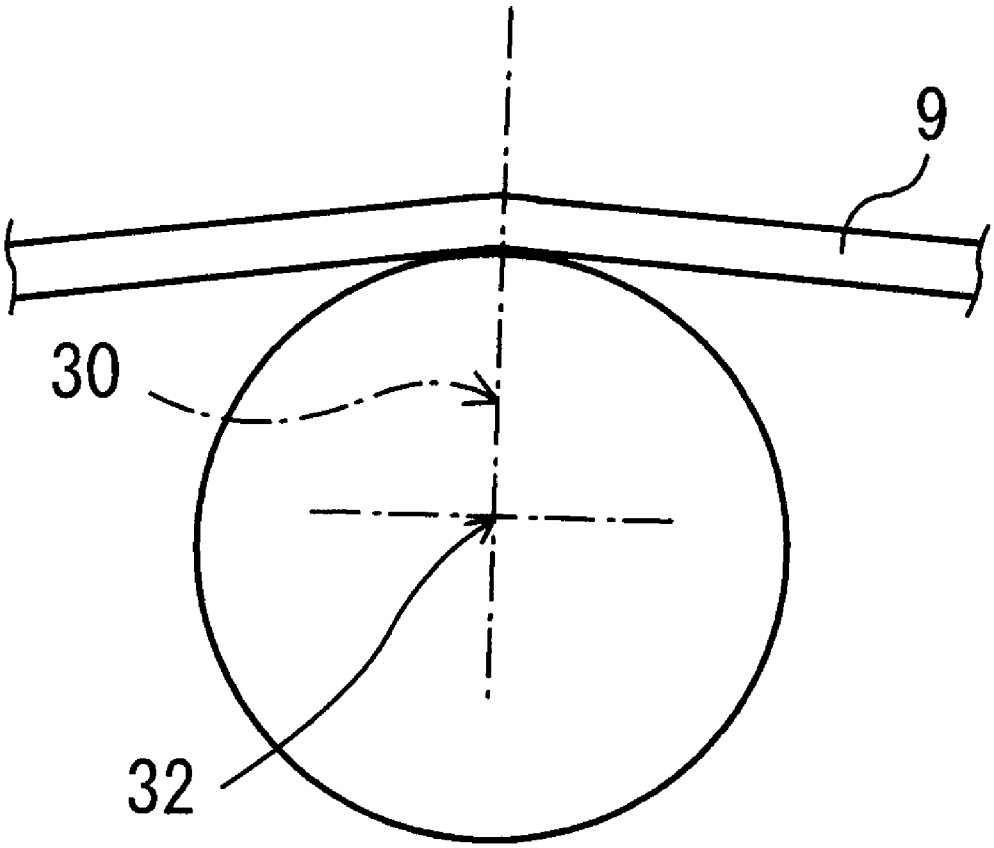
FIG. 3C is a diagram showing the construction of a mesh electrode unit and a toner carry roller used in the image forming apparatus.

For example, in the above embodiment, the aperture electrode unit is used as the toner flow control means, however, a mesh-type electrode unit 9 as disclosed in U.S. Pat. No. 5,036,341 and shown in FIG. 3C may be used.

Figure 5:
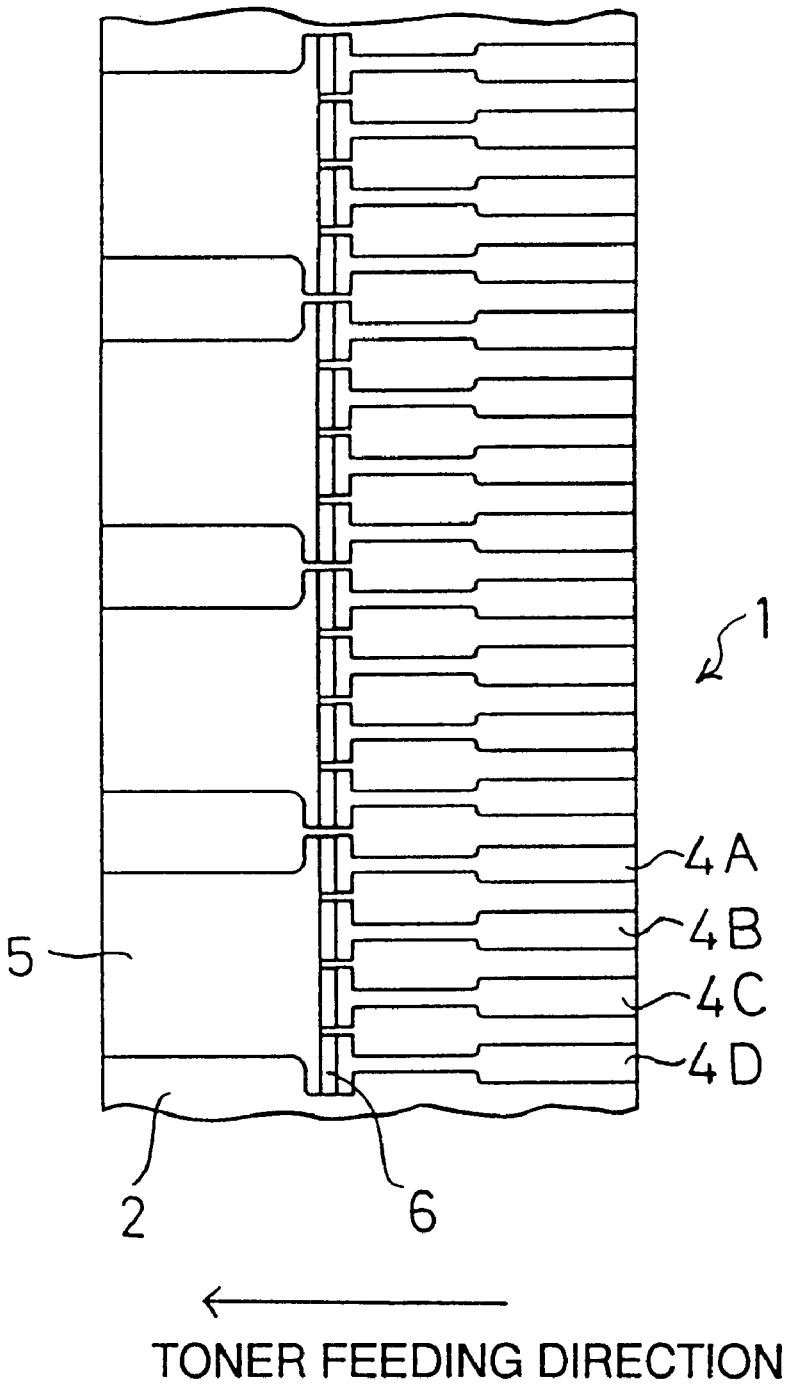
FIG. 5 is a plain view showing the construction of a first modification of the aperture electrode unit.

Further, in the above embodiment, the time-divisional driving mode of ½ duty is used; however, the driving mode is not limited to the above embodiment, and the construction of the aperture electrode unit may be designed to be matched with a time-divisional driving mode of ¼ duty as shown in FIG. 5.

FIG. 5 is a plan view of an aperture electrode unit that is usable for the ¼ duty time-divisional driving mode. The same elements as the embodiment as described above are represented by the same reference numerals. In this case, a selection electrode 4 is allocated to each aperture 6, and a data electrode 5 is allocated to four adjacent apertures. With this construction, the number of driving circuits for the data electrodes can be reduced to a quarter of that in a direct driving mode, and the cost can be further reduced.

Figure 6:
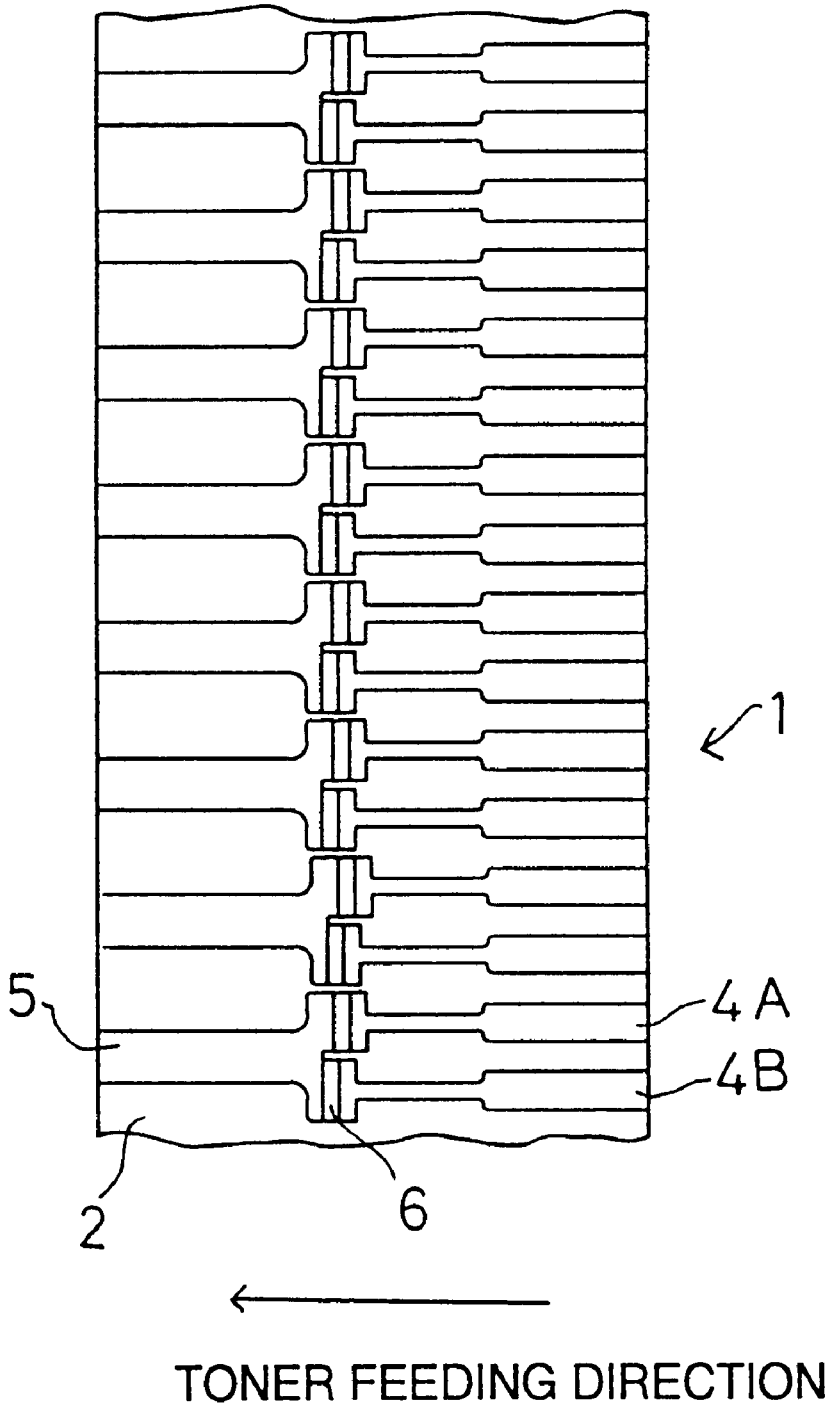
FIG. 6 is a plain view showing the construction of a second modification of the aperture electrode unit.

Further, in the above embodiment, the apertures are aligned with one another in the sheet feeding direction, however, they may be arranged so as to be positionally deviated from one another in consideration of the responsibility of the toner or the timing of data. FIG. 6 is a plan view showing an aperture electrode having a wobbled arrangement of apertures. In this case, apertures 6 that are contacted with the same data electrode 5 are positionally deviated from each other in the sheet feeding direction, and the apertures are provided with selection electrodes 4. If the apertures 6 are aligned with one another, a dot that is formed by an aperture 6 corresponding to a selection electrode 4A and a dot that is formed by an aperture 6 corresponding to a selection electrode 4B are slightly deviated from each other in the sheet feeding direction because there is a time lag between the formation times of these dots, and the sheet is slightly fed during this time lag. According to the wobbled arrangement of the apertures 6 in the sheet feeding direction as described above, dots can be formed while being aligned with one another in the sheet width direction without altering a pulse timing of data or the like.

What is claimed is:

1. An image forming apparatus comprising:

carrying means for carrying charged toner particles;

electric-field control means for controlling a flow of the charged toner particles; and a back electrode disposed facing said carrying means through said electric-field control means wherein said electric-field control means comprises an electrode unit including a plurality of openings through which the charged toner particles pass, a data electrode adjacent at least two of the plurality of openings, and a selection electrode adjacent at least one of the plurality of openings; and means for time-divisionally driving said data electrode and said selection electrode.

2. The image forming apparatus as claimed in claim 1, wherein the data electrode controls the charged particles passing through the at least two of the plurality of openings.

3. The image forming apparatus as claimed in claim 1, wherein said electrode unit comprises a plurality of selection electrodes substantially corresponding to a number of said openings and a plurality of data electrodes.

4. The image forming apparatus as claimed in claim 3, comprising at least two selection electrodes for each of said data electrodes.

5. The image forming apparatus as claimed in claim 4, comprising four selection electrodes for each of said data electrodes.

6. The image forming apparatus as claimed in claim 3, wherein the electrode unit further includes an insulating sheet, and said selection electrodes and said data electrodes are disposed between said carrying means and said insulating sheet.

7. The image forming apparatus as claimed in claim 3, wherein the electrode unit further includes an insulating sheet, and said selection electrodes and said data electrodes are disposed between said insulating sheet and said back electrode.

8. The image forming apparatus as claimed in claim 3, wherein said selection electrodes are disposed at an upstream side of a toner feeding direction, and wherein each of said data electrodes is disposed at a downstream side of the toner feeding direction.

9. The image forming apparatus as claimed in claim 3, further comprising a control voltage applying circuit operatively coupled to said selection electrodes and data electrodes, said control voltage applying circuit applying specified voltages to said selection electrodes and data electrodes.

10. The image forming apparatus as claimed in claim 1, wherein said electrode unit comprises one of an aperture electrode unit and a mesh electrode unit.

11. An image forming apparatus comprising:

a toner carrier that carries charged toner particles;

an electrode unit group disposed adjacent said toner carrier, said electrode unit group controlling a flow of the charged toner particles; and a back electrode disposed facing said toner carrier through said electrode unit group, wherein said electrode unit group comprises an electrode unit including a plurality of openings through which the charged toner particles pass, a data electrode adjacent at least two of the plurality of openings, and a selection electrode adjacent at least one of the plurality of openings; and circuitry that time-divisionally drives said data electrode and said selection electrode.

12. The image forming apparatus as claimed in claim 11, wherein the data electrode controls the charged particles passing through at least two of the plurality of openings.

13. The image forming apparatus as claimed in claim 11, wherein said electrode unit group comprises a plurality of selection electrodes substantially corresponding to a number of said openings and a plurality of data electrodes.

14. The image forming apparatus as claimed in claim 13, comprising at least two selection electrodes for each of said data electrodes.

15. The image forming apparatus as claimed in claim 14, comprising four selection electrodes for each of said data electrodes.

16. The image forming apparatus as claimed in claim 13, wherein the electrode unit further includes an insulating sheet, and said selection electrodes and said data electrodes are disposed between said toner carrier and said insulating sheet.

17. The image forming apparatus as claimed in claim 13, wherein the electrode unit further includes an insulating sheet, and said selection electrodes and said data electrodes are disposed between said insulating sheet and said back electrode.

18. The image forming apparatus as claimed in claim 13, wherein said selection electrodes are disposed at an upstream side of a toner feeding direction, and wherein each of said data electrodes is disposed at a downstream side of the toner feeding direction.

19. The image forming apparatus as claimed in claim 13, further comprising a control voltage applying circuit operatively coupled to said electrode unit group, said control voltage applying circuit applying specified voltages to said selection electrodes and said data electrode unit.

* * * * *